US005105638A

United States Patent [19]

Mito et al.

[11] Patent Number: 5,105,638

[45] Date of Patent: Apr. 21, 1992

[54] METHOD AND MACHINE FOR ROLLING A METAL WORKPIECE AT A REDUCED ROLLING LOAD

[75] Inventors: Yoshiki Mito; Hiroshi Aratani; Kazuo Morimoto; Keiji Mizuta; Osamu Miyamoto; Yukio Hiasa; Hideaki Furumoto, all of Hiroshima, Japan

[73] Assignee: Mitsubishi Jukogyo Kabushiki Kaisha, Tokyo, Japan

[21] Appl. No.: 714,940

[22] Filed: Jun. 13, 1991

Related U.S. Application Data

[63] Continuation-in-part of Ser. No. 554,061, Jul. 12, 1990, which is a continuation-in-part of Ser. No. 348,641, May 8, 1989, abandoned.

[51] Int. Cl.[5] ..... B21B 27/06

[52] U.S. Cl. ..... 72/41; 72/187; 72/366.2

[58] Field of Search ..... 72/41, 42, 187, 198, 72/201, 252.5, 365.2, 366.2

[56] References Cited

U.S. PATENT DOCUMENTS

| | | |
|---|---|---|
| 1,490,944 | 4/1924 | Simpson . |
| 1,960,958 | 5/1934 | Sargent . |
| 2,075,273 | 3/1937 | Dahl . |
| 2,361,039 | 10/1944 | Langel . |
| 3,150,548 | 9/1964 | Roberts . |
| 3,911,704 | 10/1975 | Bridenbaugh et al. . |
| 3,956,915 | 5/1976 | Saunders . |
| 4,071,657 | 1/1978 | Rault . |
| 4,087,898 | 5/1978 | Linne . |
| 4,379,396 | 4/1983 | Hope et al. . |

FOREIGN PATENT DOCUMENTS

| | | |
|---|---|---|
| 635220 | 9/1936 | Fed. Rep. of Germany . |
| 2290623 | 6/1976 | France . |
| 57-41801 | 3/1982 | Japan . |
| 303118 | 5/1971 | U.S.S.R. . |
| 82/03575 | 10/1982 | World Int. Prop. O. . |

*Primary Examiner*—Lowell A. Larson

*Attorney, Agent, or Firm*—Wenderoth, Lind & Ponack

[57] ABSTRACT

A rolling method and machine provides for decreasing the rolling load of work rolls of a rolling mill for a given reduction ratio achieved thereby. A pair of pinch rolls upstream of the work rolls have projections that form a large number of recesses in one or both surfaces of a metal workpiece. A lubricating agent is forced into the recesses in the region of contact between the workpiece and the work rolls. As a result, when the workpiece is rolled by the work rolls the lubricating agent is retained in the recesses such that the recesses progressively are flattened, thereby causing the lubricating agent to form a boundary film between the portion of the workpiece being rolled and the work rolls. The recesses are controlled to regulate the dimension of the length of each recess in the direction of rolling of the workpiece, to regulate the inclination of front and rear walls of each recess, and to regulate the total area of the recesses relative to the total surface area of the workpiece.

25 Claims, 12 Drawing Sheets

METHOD AND MACHINE FOR ROLLING A METAL WORKPIECE AT A REDUCED ROLLING LOAD

CROSS REFERENCE TO EARLIER APPLICATIONS

This is a continuation-in-part of application Ser. No. 554,061, filed Jul. 12, 1990, now abandoned, which is a continuation-in-part of application Ser. No. 348,641 filed May 8, 1989, now abandoned.

BACKGROUND OF THE INVENTION

The present invention relates to a method and machine for rolling a workpiece formed of metal, for example steel, aluminum and the like.

More particularly, the present invention relates to such a method and machine employable in the rolling mill technology for rolling workpieces such as metal plate, shaped metal, bar metal, etc.

Further particularly, the present invention relates to such a method and machine whereby it is possible to subject the metal workpiece to compressive forces causing plastic deformation of the workpiece, but under conditions of reduced coefficient of friction and thereby reduced rolling load for a given reduction ratio.

Conventionally, both hot rolling and cold rolling are employed for reducing metal workpieces. Typically hot rolling of steel, aluminum and the like workpieces such as plate, band, bar and strip stock is achieved in a hot strip mill. On the other hand, cold rolling of such stock typically employs a tandem cold mill. In such mills the stock is passed between a pair of upper and lower rotating work rolls to achieve reduction of the stock by plastic deformation thereof under compressive force conditions. High friction is generated between the workpiece and the work rolls during these rolling operations. It is desirable to decrease such friction to reduce the load required to effect plastic deformation and also to prevent abrasive wear of the work rolls and the creation of surface flaws and defects in the workpiece being rolled.

It is known to decrease such friction by employing a lubricating agent, for example a fluid, to be applied to the surfaces of the workpiece and/or to the surfaces of the work rolls. Past attempts to reduce friction by the use of a lubricating agent have suffered from certain disadvantages.

In cold rolling, to provide the necessary reduction radio it is necessary to impart extremely high pressures to the work rolls to increase the rate of compressive force. As a result, arcuate surfaces of the rolls contact opposite surfaces of the workpiece under extremely high pressures. This prevents a lubricating agent from directly entering between the contact surfaces of the workpiece and the work rolls. As a result, the lubricating agent is only partially effective and does not in fact provide sufficient lubrication.

In the case of hot rolling, the temperature of the workpiece can reach approximately 900° C. to 1200° C. during a hot rolling operation. The lubricating agent is applied to the work rolls, but the work rolls also are heated due to the high temperature environment. Lubricating agents burn at a relatively low temperature, for example 200° C. As a result, the lubricating agent ceases to function as a lubricant, and only a relatively slight amount of lubricating agent will remain on the work rolls. This results in insufficient lubrication of the work rolls, with a consequent abrasion of the work rolls. The poor lubricating effect and the abrasion of the work rolls increase the coefficient of friction between the workpiece and the work rolls. As a result, a large rolling load is required to maintain a desired reduction ratio of the workpiece.

In many actual conventional hot rolling operations, the only lubricating fluid actually present between the work rolls and the workpiece is air. Air cannot operate as a boundary film due to its compressibility. As a result, the entire workpiece is placed in metal-to-metal contact with the work rolls, i.e. every surface region of the workpiece is brought into a state of boundary friction with the work rolls. As a result, the coefficient of friction between the work rolls and the workpiece becomes at least 0.2 or more ($\mu \geqq 0.2$). This causes the rolling load to increase, the surfaces of the work rolls to become worn and deteriorated, damage to the workpiece, etc.

As a result of the above disadvantages of conventional rolling mills, the rolled workpiece has, in the widthwise direction thereof, surface irregularities such as local projections or high spots, a defective shape, and zig-zag surface configurations.

SUMMARY OF THE INVENTION

With the above discussion in mind, it is an object of the present invention to provide a method and machine for rolling a metal workpiece whereby it is possible to reduce the coefficient of friction resulting during a rolling operation, and thereby reducing the rolling load.

It is a further object of the present invention to provide such a method and machine whereby it is possible to overcome the above and other prior art disadvantages.

It is a yet further object of the present invention to provide such a method and machine whereby it is possible to reduce abrasion and wear of the work rolls of a rolling mill, decrease the rolling load, maintain a reduction ratio at least equal to that of prior art systems, and enable the rolling machine to be made more compact and of smaller size.

It is a still further object of the present invention to provide such a method and machine employable in both hot rolling and cold rolling environments.

The above and other objects are achieved in accordance with one aspect of the present invention by the provision of a recess impressing unit, for example a pair of pinch rollers, upstream of the work rolls. The workpiece is passed through the recess impressing unit such that a large number of recesses are formed in one or both of opposite surfaces of the workpiece. The pinch rolls have projections that are forced into the surface or surfaces of the workpiece, thereby forming the large number of recesses. Each recess has a radius of curvature less than that of the work rolls of the rolling mill. A lubricating agent is introduced, for example by spraying, into the recesses in the region of contact between the workpiece and the work rolls. As a result, the lubricating agent is retained and confined in the recesses, and when the workpiece is passed to and pressed between the work rolls, the lubricating agent thus confined in the recesses is expanded due to progressive flattening of the recesses to form a boundary film between the portion of the workpiece being rolled and the work rolls. After being passed between the work rolls, the recesses previously in the surfaces of the workpiece are rolled smooth due to the plastic deformation and reduction of the workpiece.

In accordance with another aspect of the present invention, each recess formed in a surface of the workpiece has an opening or entrance the length of which is at least 3 mm in the direction in which the workpiece is rolled and no greater than 30% of the length of arcuate contact between the work roll and the workpiece. The lubricant is fed to the area between the work rolls and the workpiece and is contained in the recesses in the workpiece. The recesses are covered when the work rolls are brought into contact with the workpiece. The volume of the recesses is decreased during rolling of the workpiece. This results in an increase in pressure and thus effectiveness of the lubricating agent. When the recesses are apart from the rolls, the lubricant is exposed to the atmosphere. This results in a decrease in pressure and thus effectiveness of the lubricant.

In accordance with a yet further aspect of the present invention, each recess has front and rear walls inclined at an angle of between 30° and 65° relative to the top surface of the workpiece. In accordance with this aspect of the present invention, the shape of the recess is given substantial weight. Particularly, if the recess is not properly shaped, the side walls thereof, i.e. the front and rear walls, will become inclined inwardly to form double or overlapping surfaces, thereby deteriorating the quality of the workpiece. This aspect of the present invention therefore provides for a reduced coefficient of friction and a high ratio of compressive force without causing a decrease in the quality of the workpiece.

In accordance with a yet further aspect of the present invention, the area of the recesses formed in each surface of the workpiece is from 20 to 70% of the total surface area of the workpiece. In accordance with this aspect of the invention, the ratio of the area of the recesses is determined to have an important influence on the achievement of a lubricating effect necessary to achieve a desired reduction of the coefficient of friction.

BRIEF DESCRIPTION OF THE DRAWINGS

Other objects, features and advantages of the present invention will be apparent from the following detailed description of preferred embodiments thereof, with reference to the accompanying drawings, wherein:

FIG. 20(*b*) is a view similar to FIG. 20(*a*) but illustrating the reaction of lubricant in a recess having a wall at least 30°;

FIG. 21(*b*) illustrates a workpiece surface after rolling and employing the recess shown in FIG. 21(*a*);

DETAILED DESCRIPTION OF THE INVENTION

Various aspects and embodiments of the present invention now will be described in greater detail.

Figure 1:
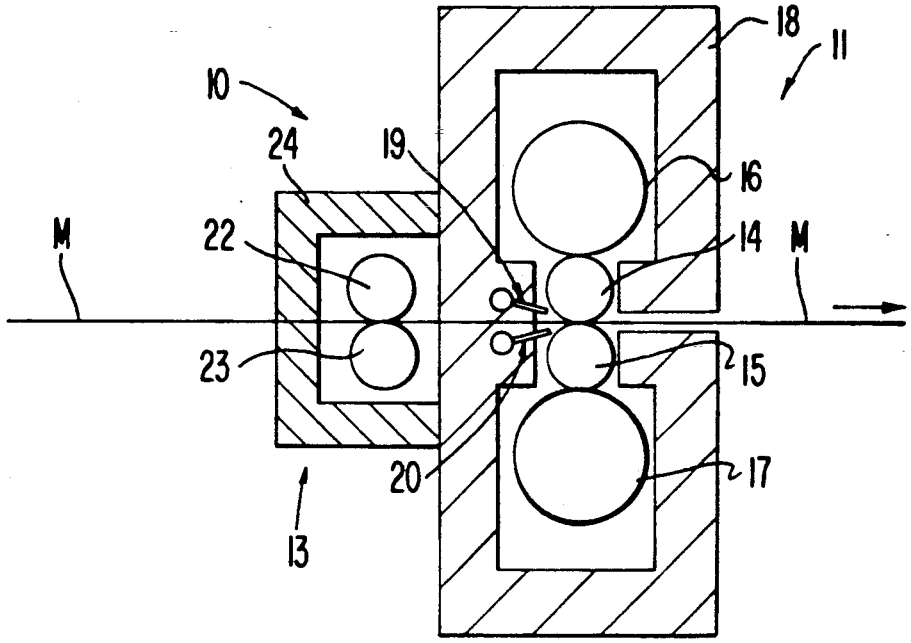
FIG. 1 is a schematic view of an embodiment of a rolling machine according to the present invention.

FIG. 1 schematically illustrates a rolling machine according to the present invention. Rolling machine 10 includes a rolling mill 11 for rolling a workpiece M, in the form of a metal plate or band, by reduction thereof, and a recess impressing unit 13 positioned upstream of rolling mill 11 at an inlet thereof for forming recesses 12 in one or both of opposite surfaces of workpiece M.

Rolling mill 11 includes upper and lower work rolls 14, 15 for rolling workpiece M and backup rolls 16, 17 rotatable in contact with rolls 14, 15, respectively, to bear the reaction force thereof. Rolls 14–17 are rotatably supported by and within a housing 18.

Figure 3:
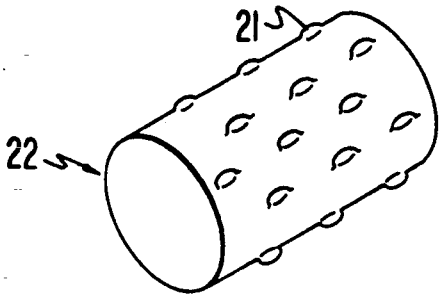
FIG. 3 is a perspective view of a pinch roll shown in FIG. 2.

Recess impressing unit 13 provided upstream of rolling mill 11 includes a pair of pinch rollers 22, 23 having thereon a large number of projections 21 as shown in FIG. 3. Pinch rolls 22, 23 are rotatably supported by a housing 24 to pinch workpiece M being fed therebetween. Pinch rolls 22, 23 pinch the workpiece M at a pressure sufficient for recesses 12 to be formed by corresponding projections 21 by virtue of plastic deformation of workpiece M being fed. The curvature of each recess 12 formed by a respective projection 21 is greater than that of the work roll 14 or 15, i.e. the radius of curvature of recess 12 is less than that of work roll 14 or 15. However, the shape of recess 12 can have various other forms as will be discussed subsequently, as long as the recess can be and will be pressed substantially completely flat at the time of rolling by work rolls 14, 15.

FIG. 1 also illustrates nozzles 19 and 20 provided on the inlet side of movement of workpiece M into and between work rolls 14, 15. Nozzles 19, 20 spray a lubricating agent or fluid L to portions of workpiece M contacting work rolls 14, 15.

Figure 4:
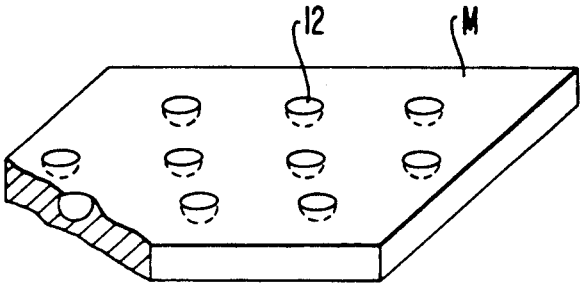
FIG. 4 is a perspective view of a plate-shaped workpiece having recesses formed by the pinch roll of FIG. 3.

Accordingly, when the workpiece M is fed to the right as viewed in FIG. 1, firstly a large number of recesses 12 are formed in one or both of opposite surfaces of workpiece M by the recess impressing unit 13. The recesses 12 are as shown in FIG. 4. Then, when the workpiece M having the recesses 12 is fed to rolling mill 11, lubricating fluid L is sprayed into the contacting portions between the work rolls 14, 15 and the workpiece M. Such lubricating fluid is retained in the recesses before being caught in the contacting arc regions $\alpha$ of the work rolls 14, 15 with the workpiece M. Thereafter, as the workpiece M is rolled and reduced between work rolls 14, 15 the lubricating fluid L in recesses 12 is temporarily confined in recesses 12 because the surfaces of work rolls 14, 15 contact with margins of the openings of the recesses. On the other hand, the fluid adhering to the surfaces of work rolls 14, 15 is introduced into the recesses 12 as work rolls 14, 15 rotate. Then, as rolling progresses, the fluid L confined in the recesses 12 forms a boundary film over the contacting portions between work rolls 14, 15 and workpiece M. This is due to the fact that the recesses 12 are gradually expanded thin and flat within the contacting arc regions. Due to the formation of the boundary film the lubricating fluid L substantially remains in the contacting arc regions at the time the workpiece M is being rolled and reduced by rolls 14, 15. Accordingly, in contrast with prior art arrangements, abrasion of the work rolls is reduced. Also, since a large number of recesses are formed in the workpiece M, the amount of lubricating fluid L being sprayed is sufficient so long as it is enough to be confined in the recesses 12 and substantially remain therein. Therefore, consumption of the lubricating fluid can be decreased remarkably compared with prior art arrangements.

Although the foregoing and subsequently described embodiments of the present invention employ pinch rolls 22, 23 to form recesses 12, such that plastic deformation is achieved by a rolling operation, it is contemplated that the recesses 12 may be formed by other means, for example by pressing or cutting operations.

Considering reduction of the coefficient of friction between the work rolls and the workpiece according to the present invention, a general expression of the frictional shearing stress $\tau$ will be given below as:

$$\tau = a\tau_b + (1-a)\tau_f$$

where $\tau_b$ ($=\mu P$) is a boundary friction zone, $$\tau_f\left(=\eta\frac{\partial u}{\partial h}\right)$$

is a fluid friction zone, $\mu$ is the coefficient of boundary friction, P is the bearing pressure of a work roll, $\eta$ is the viscosity of the lubricating fluid, u is the speed of the fluid, h is the thickness of the fluid, and a is the area ratio of the boundary friction zone. Generally, $\mu=0.2$ to 0.5, and $\tau_b > \tau_f$. Therefore, the frictional shearing stress $\tau$ can be decreased if the area ratio a is decreased. That is, according to the present invention, to decrease the area ratio a, a large number of recesses 12 are formed in the surface of the workpiece M before rolling, and rolling is performed while confining the lubricating fluid L in the recesses 12. Therefore, the value of the area ratio a can be arbitrarily controlled by confining the fluid L in the recesses 12 formed in the workpiece M. Furthermore, the lubricating effect of the lubricating fluid can be enhanced compared to prior art arrangements merely by confining a relatively small amount of lubricating fluid L in recesses 12.

The lubricating fluid or agent employed in the present invention may include lubricating oil such as mineral oil employed previously, water, a mixture of water and lubricating oil, etc. In the case of a hot rolling operating, there may be used molten salt and glass which change to a liquid state at high temperature conditions of the workpiece. It particularly is contemplated in accordance with the present invention that water alone may be sufficient to achieve good lubrication in a hot rolling operation due to the provision of the recesses and the feeding of water as a lubricating agent to such recesses immediately prior to the workpiece being passed between the work rolls. As discussed above however, it specifically is contemplated in accordance with the present invention that such feature and the various aspects of this invention, including those discussed above and to be discussed below, can be employed both for hot rolling and for cold rolling operations. In the case of a hot rolling operation, due to the adiabatic effect of the fluid confined in the recesses, the quantity of heat conducted from the workpiece to the work rolls can be reduced, thus preventing the workpiece from being cooled by the work rolls. This is advantageous relative to the problem of heat resistance of the work rolls, and the like.

Figure 5:
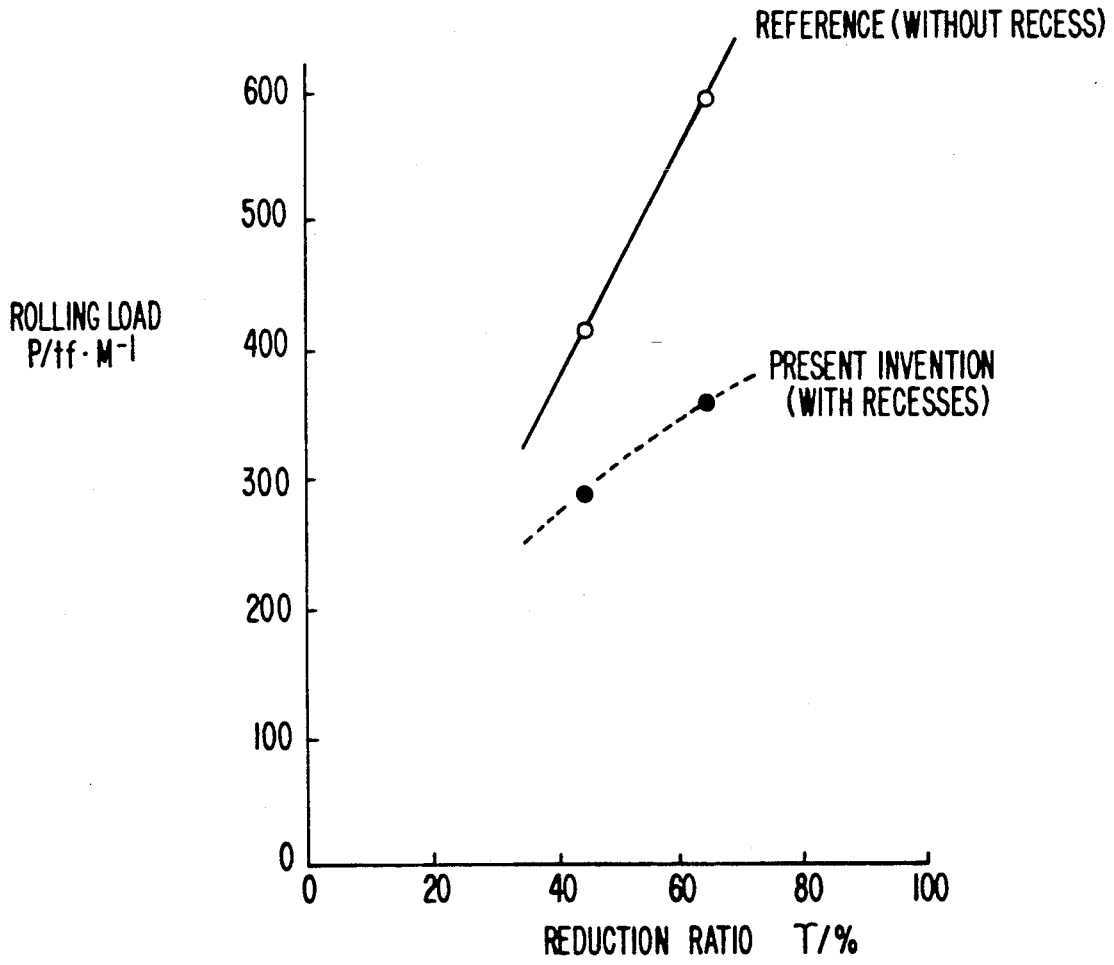
FIG. 5 is a graph showing the relationship between rolling load and reduction ratio.

A test performed to show the effectiveness of the above aspect of the present invention now will be described. In such test, the workpiece was an aluminum plate 10 mm thick that was rolled at room temperature employing a rolling mill having work rolls of 200 mm diameter. The lubricating agent employed was water, and the aluminum plate was machined to have recesses of 3 mm diameter arranged at a pitch of 3 mm. A reference workpiece was an aluminum plate having no recesses and subjected to similar rolling. FIG. 5 shows the results of this test, wherein it is illustrated that the rolling load was reduced in accordance with the present invention by approximately 20 to 40% compared with the reference workpiece having no recesses. This illustrates the effectiveness of this aspect of the present invention.

Figure 6:
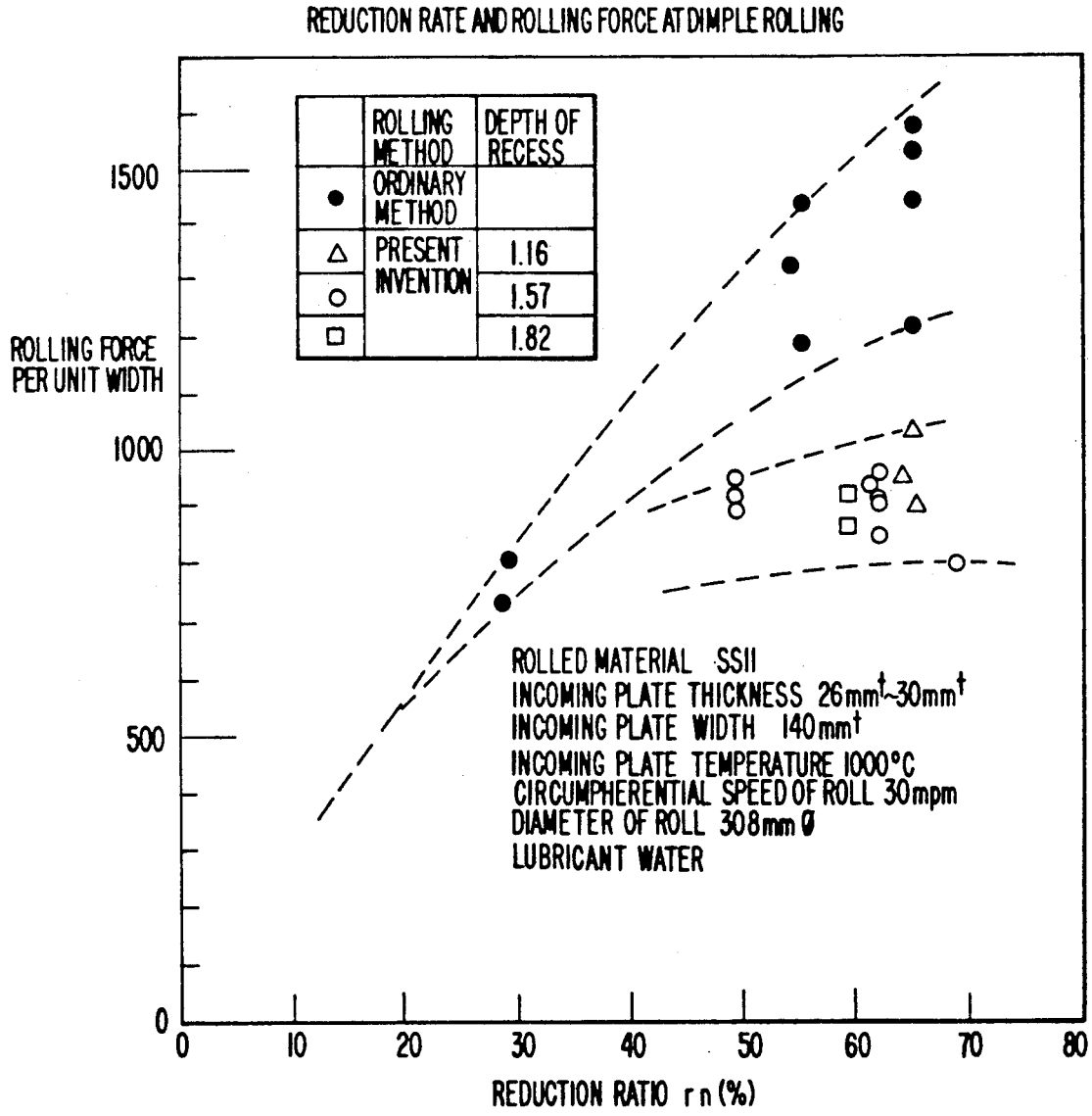
FIG. 6 is a graph showing the relationship between rolling force per unit width and reduction ratio.

Furthermore, FIG. 6 shows the results of additional tests conducted in accordance with a particularly preferred embodiment of this aspect of the present invention, as discussed above. Thus, hot rolling was conducted on a stainless steel plate having a thickness and width as indicated in the graph of FIG. 6. The hot rolling operation was conducted at a temperature of 1000° C. with work rolls having dimensions as indicated in FIG. 6. In accordance with the conventional hot rolling method indicated in FIG. 6, no recesses were formed in a reference stainless steel plate, and no lubricant was employed. FIG. 6 illustrates results of tests conducted according to three variations of the present invention, wherein the depth of the recesses 12 was 1.16 mm, 1.57 mm, and 1.82 mm. During these tests water was used as a lubricant. It will be apparent from FIG. 6 that the rolling force per unit width required to achieve a given reduction ratio was very substantially reduced in accordance with all three examples of this embodiment of the present invention.

Therefore, in accordance with this aspect of the present invention, the rolling load can be significantly reduced compared with prior art arrangements. Consequently, the individual components of the rolling mill, such as the backup rolls and housing for supporting the work rolls, can be made more compact, thereby allowing the rolling mill to be manufactured at a reduced cost. Furthermore, as described in detail with reference to the above embodiment and tests, it is possible in accordance with the present invention to reduce the coefficient of friction of the workpiece at the time of rolling and to provide a large reduction ratio even if the rolling load is very small. Yet further, the surface roughness and abrasion of the work rolls are reduced, the lubricating fluid serves effectively as an adiabatic agent, and the heat resistance of the work rolls is enhanced. Also, with the rolling load reduced, the rolling mill can be made more compact.

Figure 7:
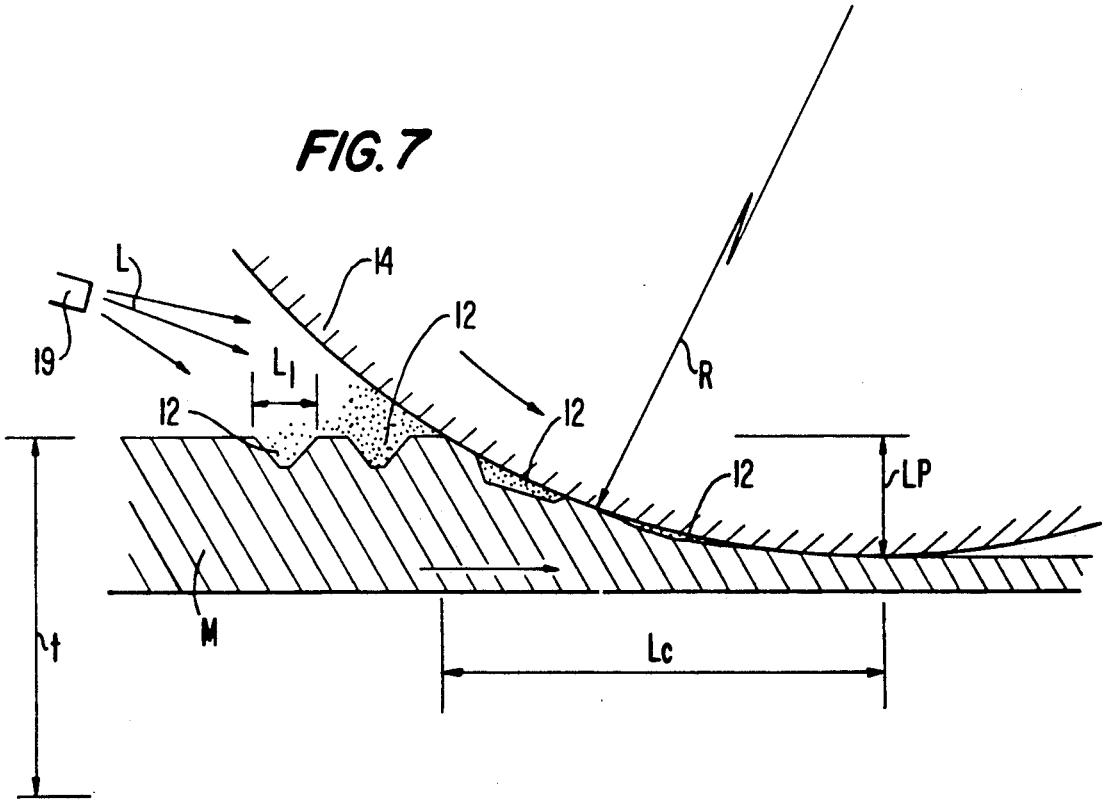
FIG. 7 is a partial sectional view illustrating a further aspect of the present invention.
Figure 8:
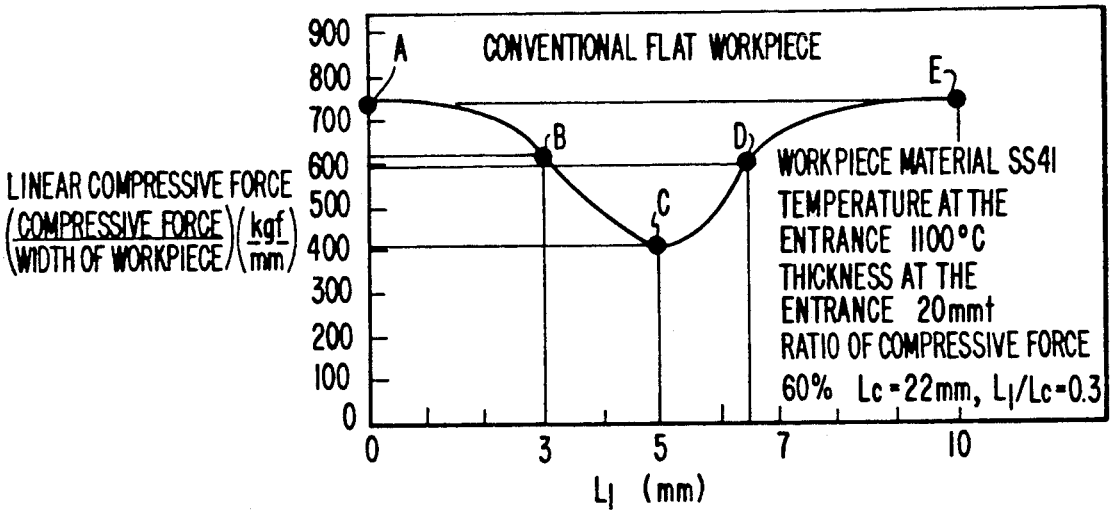
FIG. 8 is a graph illustrating the relationship between compressive force and length of a recess, with respect to the feature shown in FIG. 7.
Figure 9:
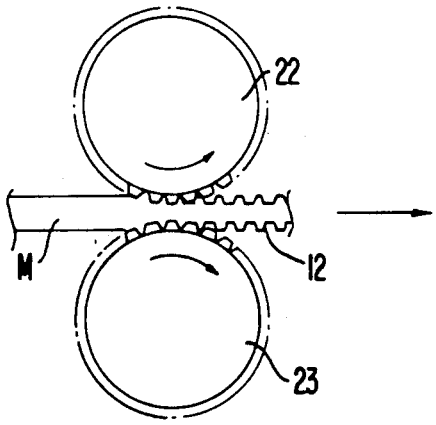
FIG. 9 is a schematic view illustrating the manner of formation of recesses such as shown in FIG. 7.

With reference to FIGS. 7-9, a further aspect of the present invention will be described. In accordance with this embodiment of the present invention, experiments have shown that if the length of a recess 12 in the direction of rolling is at least 3 mm the lubricant can be effectively contained in the recesses. Also, it has been found that this length of the recess should be no greater than 30% of the length of the arcuate region of contact between the workpiece and the work roll. In this manner, the ratio of area in which lubrication is effected, from a point where the last recesses are covered by the work roll to a point where the first recesses reach a point of discharge from the work roll, is sufficient to reduce the compressive force.

With particular reference to FIG. 7, there is shown a workpiece M having formed in one surface thereof a plurality of recesses 12. The workpiece is shown as being reduced by a work roll 14. Only work roll 14 is shown, and it of course is contemplated that work roll 15 also is provided. Furthermore, only half of the thickness t of the workpiece M is shown, but it of course is understood that the entire thickness of the workpiece is passed between the work rolls. Also, recesses 12 are shown as being formed in only the upper surface of the workpiece, but recesses also could be formed in both upper and lower surfaces thereof. Lubricant L is fed to the area of entrance of the workpiece to the roll 14, and the lubricant may be, for example, water or oil. FIG. 9 shows the manner of formation of recesses 12 in opposite surfaces of workpiece M, for example by pinch rolls 22, 23 as discussed above.

In accordance with this embodiment of the present invention, the length L1 of the opening or entrance of each recess 12 in the workpiece M, taken in the direction in which the workpiece is rolled, is at least 3 mm prior to the rolling operation. If the recess 12 is generally round, then length L1 will be the diameter of the opening of recess 12. Furthermore, the length L1 is no greater than 30% of the length Lc of arcuate contact between the workpiece and the work roll 14. That is, L1 $>3$ mm, and $L1/Lc<0.3$. In FIG. 7, R indicates the diameter of work roll 14 and is equal to 200 mm $\phi$ in this arrangement. The thickness t of workpiece M is equal to 20 mm t at the entrance to roll 14. Lp indicates the depth by which the workpiece M is reduced under the compressive force of the work rolls, and in the present instance is equal to 6 mm. As indicated, the length L1 is at least 3 mm, and preferably is at least 5 mm. The depth of each recess should be at least 1 mm, or otherwise the lubricant may not effectively enter the recess. The ratio of the area of the recesses to the total area of the workpiece should be controlled, but this will be discussed in more detail below.

In operation, the workpiece M is rolled between the work rolls while the lubricant L, for example water, is fed to the entrance between the workpiece and the work rolls. The lubricant then is received in the recesses 12. As the recesses are deformed by the rolling operation, pressure is applied to the lubricant as illustrated in FIG. 7. The lubricant then lubricates the area between the work roll and the workpiece.

FIG. 8 graphically illustrates the compressive force relative to the length L1, and also with regard to the ratio L1/Lc. A in FIG. 8 indicates the compressive force required to roll a conventional flat workpiece not having recesses while a lubricant is being fed. B, C, D indicate compressive forces required to roll workpieces with a number of recesses according to this embodiment of the invention while lubricant is fed. As illustrated, greater compressive force is required in the prior art arrangement than in the arrangement of the present invention. Further, when the length L1 of each recess is at least 3 mm and when the ratio L1/Lc is less than 0.3, the compressive force required (i.e. the roll separating force) is up to 45% less than in the prior art arrangement. The value of each point A-E shown in FIG. 8 as a result of experiments is shown in the following table.

| POINT | $L_1$ | linear compressive force (Kgf/mm) |
|---|---|---|
| A | 0 | 725 |
| B | 3.0 | 620 |
| C | 5.0 | 410 |
| D | 6.5 | 590 |
| E | 10.0 | 730 |

In accordance with this aspect of the present invention, there is provided a reduction in the friction between the workpiece and the work rolls. Thus, the ratio of compressive force necessary in the invention compared with the prior art can be reduced, e.g. by approximately 20%. This results in a decrease in size of the rolling system. Also, the machine of the invention is subjected to a lower load than in the prior art with the same compressive force (i.e. roll separating force) applied to roll a workpiece. This results in improved cost and productivity. Attention is directed to the fact that the above discussion referring to the ratio of compressive force refers to the fact that the compression rate may be increased compared to prior art arrangements with the same compressive force. Such increase can be approximately 20%.

With reference to FIGS. 10-22(*b*), a further aspect of the present invention will be described.

In accordance with this embodiment of the invention, the shape of the recess, particularly the front and rear walls thereof taken in the direction of rolling movement of the workpiece, is given special attention. Particularly, if the recess is not properly shaped, it can occur that such walls will be inclined inwardly during rolling of the workpiece by the work rolls, to thereby form double or overlapping surfaces. This doubling or overlapping of the workpiece surfaces would cause a deterioration of a quality of the workpiece. Therefore, in accordance with this aspect of the present invention, the shape of each recess, and particularly the front and rear walls thereof in the direction of rolling movement of the workpiece, is controlled to ensure, not only reduced coefficient of friction and an improved ratio of compressive force compared to prior art arrangements, but that this can be achieved without a reduction or detriment to the quality of the workpiece.

More particularly, the front and rear walls of the recess are inclined relative to the top surface of the workpiece at angles of at least 30° thereby to ensure entry of lubricating fluid into and retention in the recess. These angles are no greater than 65°, to thereby prevent inward inclination and doubling of the workpiece surface during rolling by the work rolls.

Figure 2:
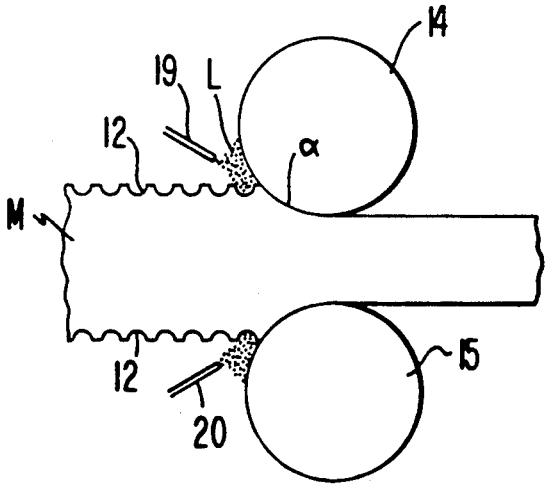
FIG. 2 is an enlarged view of a portion of the machine of FIG. 1.
Figure 10:
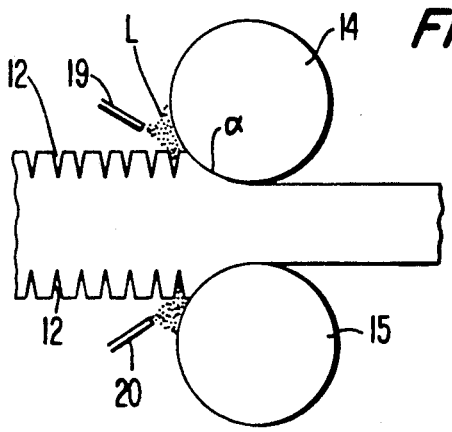
FIG. 10 is a view similar to FIGS. 2 and 9, but illustrating the formation of recesses of a different configuration.
Figure 11:
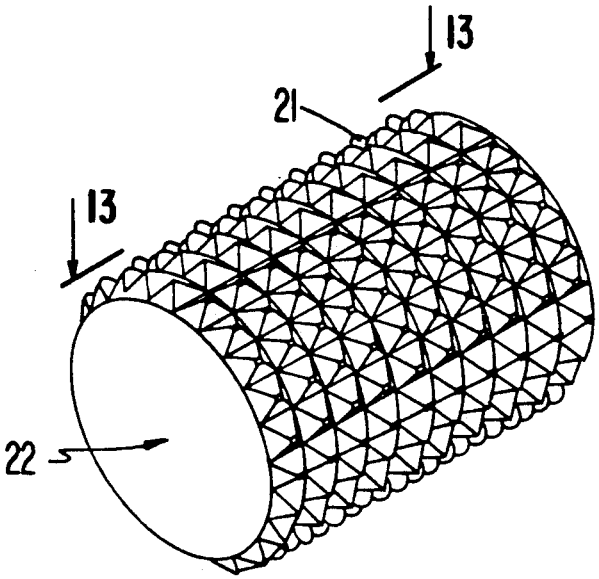
FIG. 11 is a perspective view of one pinch roll employed in FIG. 10.
Figure 12:
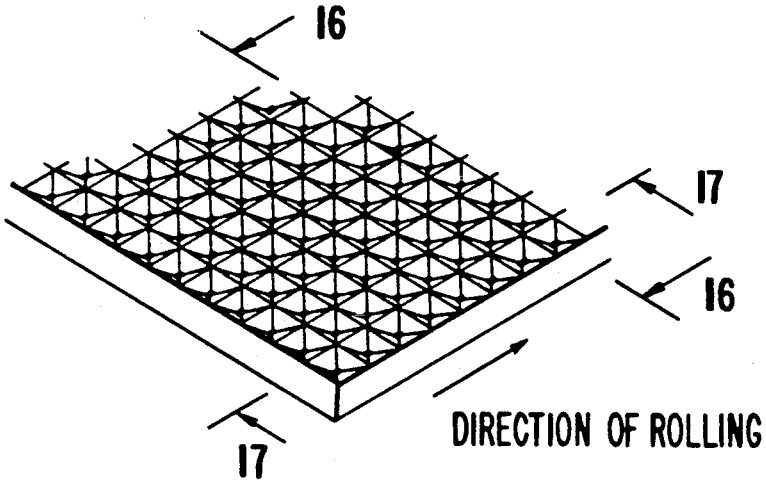
FIG. 12 is a perspective view of a metal plate having therein surface recesses formed by the pinch roll of FIG. 11.

More particularly, FIG. 10 is a view similar to FIG. 2, but illustrating a different shape of recesses 12, specifically the result of use of pinch rolls such as shown at 22 in FIG. 11. FIG. 10 otherwise is the same as FIG. 2, and the operation of the machine of the present invention in accordance with the method of the present invention otherwise is similar to the above discussion. The recesses 12 shown in FIG. 12 are formed by the pinch roll 22 shown in FIG. 11.

Figure 14:
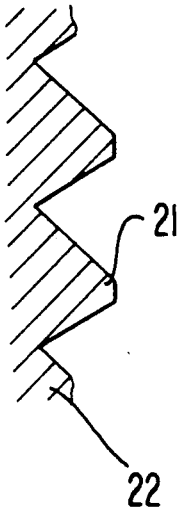
FIG. 14 is a cross-sectional view along line 14—14 of FIG. 13.
Figure 13:
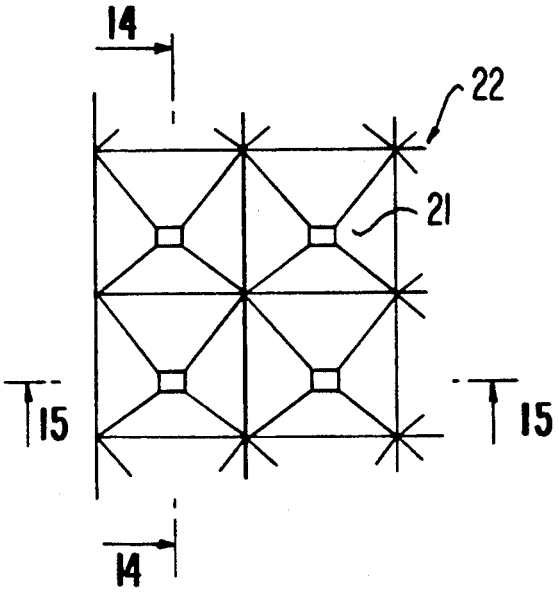
FIG. 13 is a partial sectional view taken along line 13—13 of FIG. 11.
Figure 15:
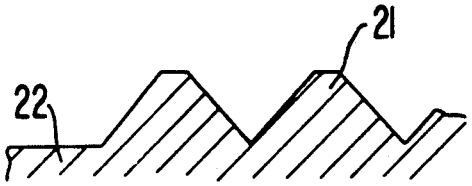
FIG. 15 is a sectional view along line 15—15 of FIG. 13.

Particular attention is directed to FIGS. 13-15 that illustrate a specific example of this embodiment of the present invention. Therein is shown a pinch roll 22 having a plurality of projections 21 each in the form of a truncated quadrangular pyramid. Each projection has a front surface, taken in the direction in which the workpiece is rolled, inclined at an angle of 65°, a rear surface inclined at an angle of 45°, and opposite side walls inclined at angles of 50°. Projection 21 has a length in the direction in which the workpiece is rolled of 5.5 mm, a width of 6 mm and a height of 3 mm. The ratio of the depth d of recess 12 to the height h of the projection 21 is approximately equal to 0.1 to 0.8. The ratio of the area of all of recesses 12 on a given workpiece surface to the total workpiece surface area will be from 20 to 70%, as discussed in more detail below.

Figure 16:
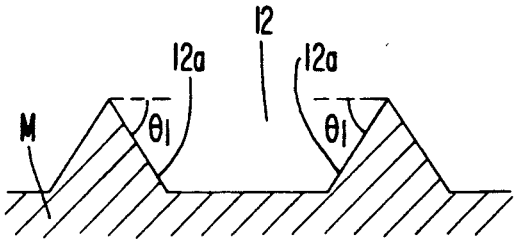
FIG. 16 is a sectional view along line 16—16 of FIG. 12.
Figure 17:
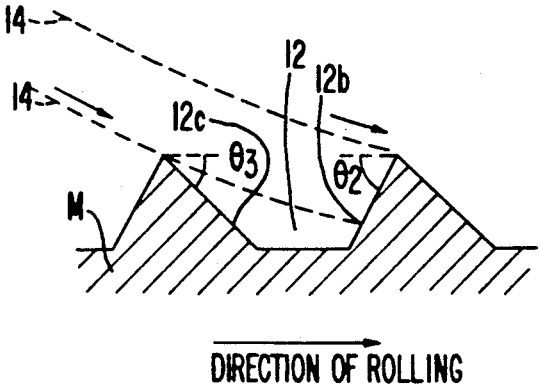
FIG. 17 is a sectional view along line 17—17 of FIG. 12.

FIGS. 16 and 17 illustrate the shape of recesses 12 in more detail. For example, in FIG. 16 are illustrated two side walls 12*a* of a recess 12 formed in workpiece M by a projection 21. Walls 12*a* are both inclined at an equal angle of $\Theta_1$ of 50° relative to the top surface of the workpiece M. As shown in FIG. 17, recess 12 also includes a front wall 12*b* inclined at an angle $\Theta_2$ equal to 60° relative to the top surface of the workpiece and a rear wall 12*c* inclined at an angle $\Theta_3$ of 45° relative to the top surface of the workpiece. Thus, in this specific example of this embodiment of the present invention, both front and rear walls 12*b*, 12*c* are inclined at respective angles within the range of between 30° and 65° discussed above.

Figure 18:
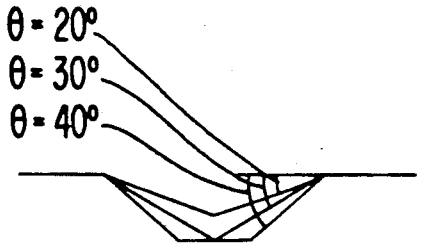
FIG. 18, is a schematic view illustrating different angles of walls of a recess.
Figure 19:
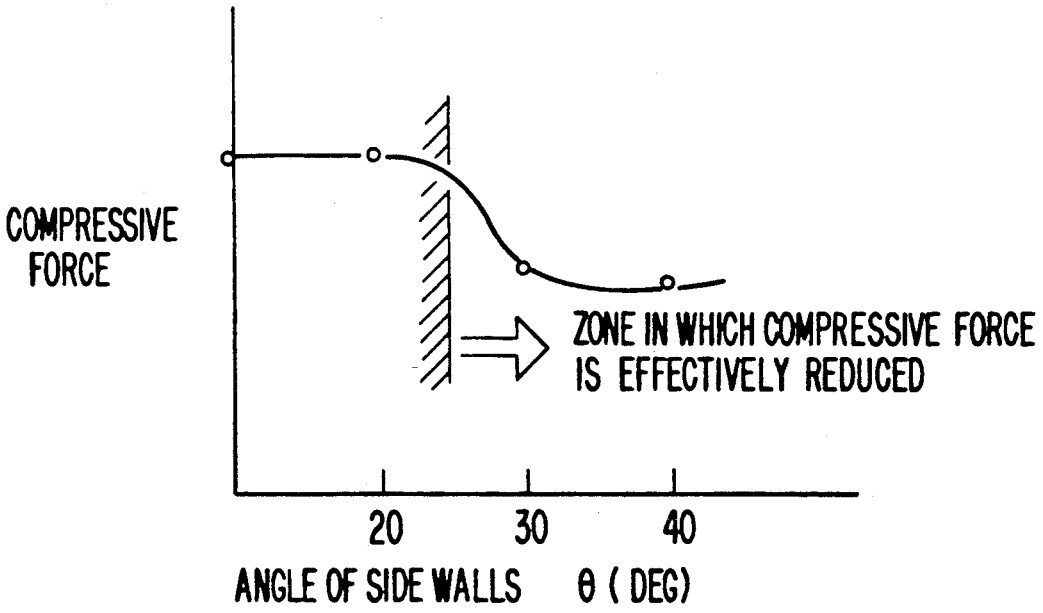
FIG. 19 is a graph illustrating the relationship between compressive force and angles of the walls of the recess.

FIGS. 18 and 19 illustrate the relationship between the angle $\Theta$ of the front and rear walls of the recess and compressive force. Particularly, FIG. 18 illustrates front and rear recess walls at angles $\Theta$ of 20°, 30° and 40°. FIG. 19 illustrates compressive forces at these different wall inclination angles. As will be apparent from FIG. 19, when angles $\Theta$ are approximately at least 25°, compressive force is reduced substantially. Therefore, as emphasized in FIG. 19, angles $\Theta$ of the front and rear walls should be at least 25° and preferably at least 30° to ensure effective reduction of compressive force.

Figure 20A:
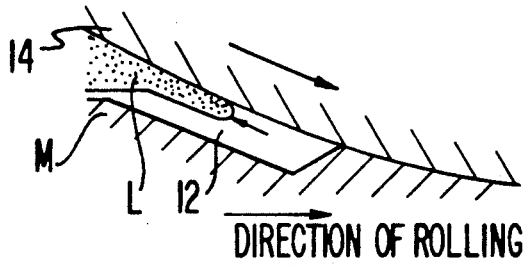
FIG. 20(*a*) is a schematic view illustrating the reaction of lubricant within a recess having a wall less than 25°.
Figure 20B:
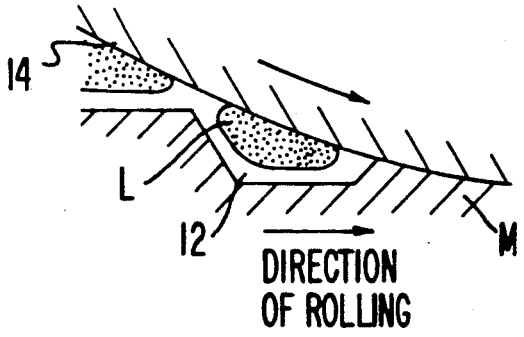

Also, FIG. 20(*a*) illustrates that if the angle $\Theta$ of the front and rear walls of the recess 12 is less than 25°, the lubricating fluid L will not be retained in the recess during rolling of the workpiece by the work roll 14. On the other hand, as shown in FIG. 20(*b*), when the angles $\Theta$ of the front and rear walls arc at least 30°, the lubricating fluid L is confined in the recess 12 during the rolling operation, thereby reducing the required load.

Figure 21A:
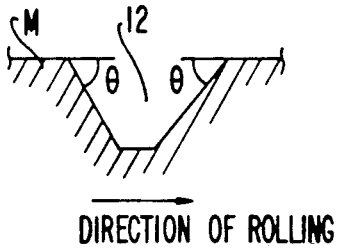
FIG. 21(*a*) illustrates recess walls inclined less than 65°.
Figure 21B:
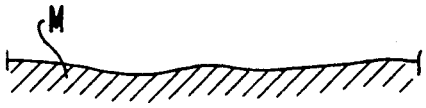
Figure 22A:
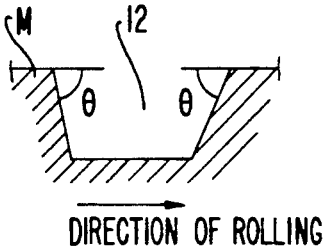
FIGS. 22(*a*) and 22(*b*) are similar to FIGS. 21(*a*) and 21(*b*), respectively, but wherein recess walls are inclined by at least 65°.
Figure 22B:
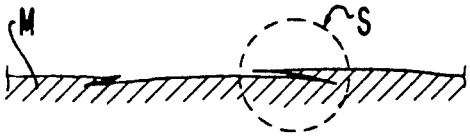

Furthermore, when the angles $\Theta_2$ and $\Theta_3$ of the front and rear walls of recess 12 are less than 65° as shown in FIG. 21(*a*), then after the rolling operation the top surface of the workpiece M will be flat as shown in FIG. 21(*b*). On the other hand, when the angles $\Theta_2$ and $\Theta_3$ of the front and rear walls of the recess are greater than 65° as shown in FIG. 22(*a*), then during the rolling operation the walls will be inclined inwardly toward each other to result in overlapping surfaces as shown by area S in FIG. 22(*b*). This results in deterioration of the quality of the surface of the rolled workpiece.

Thus, this aspect of the present invention ensures that the lubricating fluid L will be confined within the recesses 12 to effectively reduce the load required for a rolling operation. This aspect of the present invention also will prevent the formation of overlapping or double surfaces on the rolled workpiece. As a result, the compressive force can be reduced without resulting in a detriment to the quality of the rolled workpiece.

Figure 23:
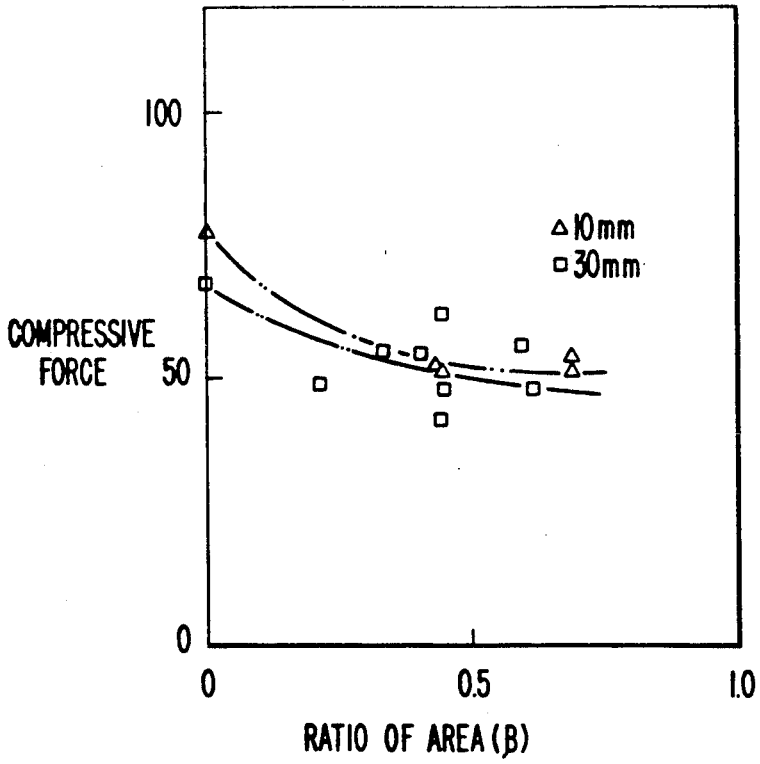
FIG. 23 is a graph illustrating the relationship between the ratio of the area of the recesses to the total surface area versus compressive force.
Figure 24:
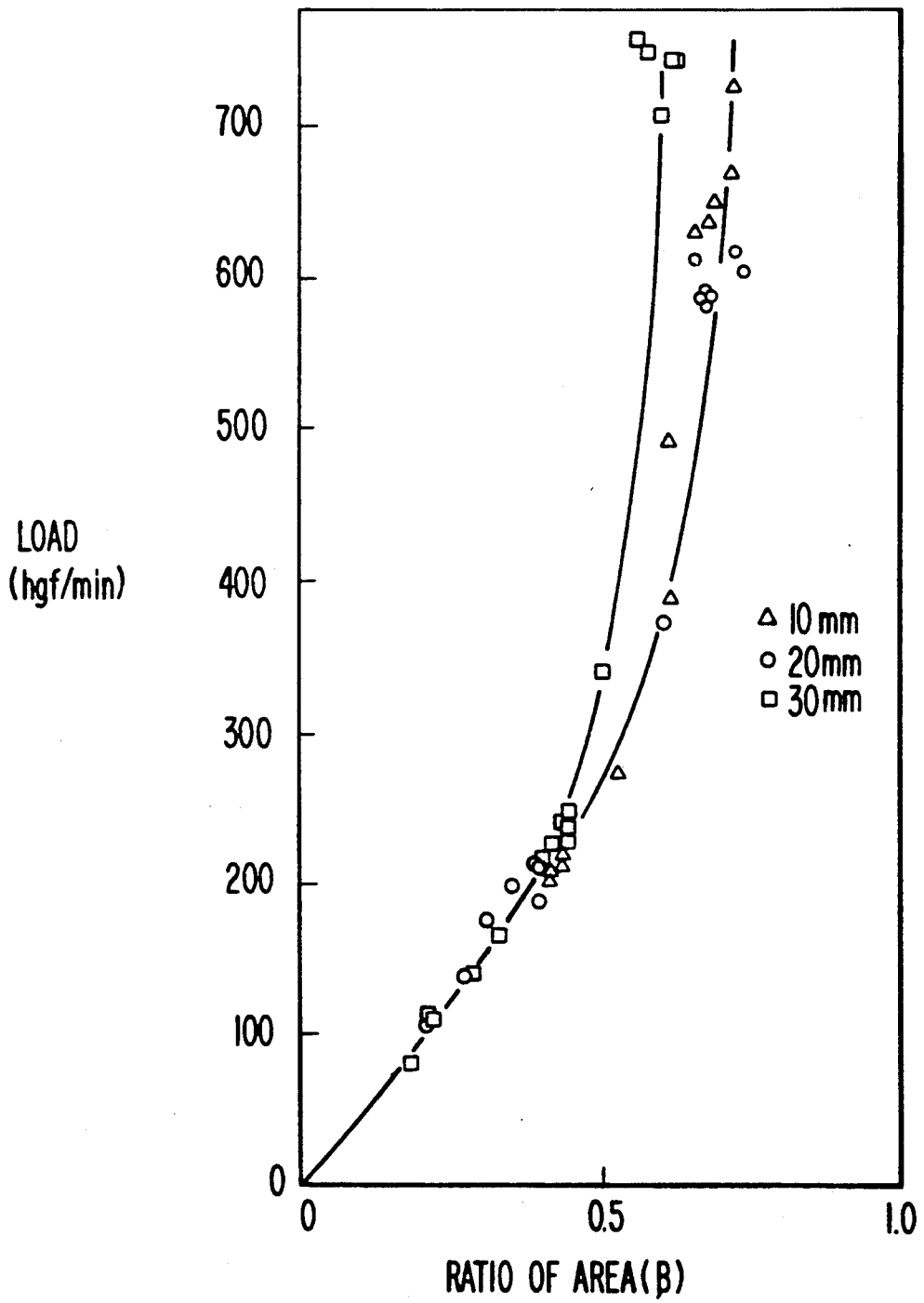
FIG. 24 is a graph showing the relationship between such ratio and the load required to form the recesses.

With reference to FIGS. 23 and 24, a further aspect of the present invention will be discussed in more detail. Thus, as discussed above regarding the embodiment of FIGS. 10 through 22(*b*) it was pointed out that the area of the recesses to the total surface area of the workpiece is within the range of 20% to 70%. In this aspect of the present invention the ratio of the area of the recesses to the total workpiece area is emphasized. If this ratio is not properly determined, then the requirement for lubrication will not be met, and the coefficient of friction will not be reduced sufficiently. Particularly, a reduction in load required to roll the workpiece can be achieved with the area of the recesses being at least 20% of the total surface area of the workpiece. Furthermore, the load required to form the recesses by plastic deformation by the pinch rolls will not be increased to an excessive extent when the area of the recesses is no greater than 70% of the total surface area of the workpiece.

The above facts are particularly illustrated in FIGS. 23 and 24. Therein the ratio of the area of recesses 12 on a workpiece surface to the total surface area of the workpiece is indicated by $\beta$. FIG. 23 illustrates the effect of this ratio on compressive force, and FIG. 24 illustrates the effect of this ratio on load. Particularly, in the tests of FIG. 23, a workpiece formed of steel has a thickness of from 10 to 30 mm and is heated at a temperature of 1100° C. while being rolled by rolls having a diameter of 230 mm. As illustrated, the compressive force drastically drops when the ratio $\beta$ is above 0.2 (i.e. 20%). Thus, the load required to roll a workpiece when hot can be reduced by ensuring that the ratio $\beta$ of the area of recesses 12 to the total surface area of the workpiece is at least 20%.

FIG. 24 illustrates the relationship between the load require to form the recesses 12 in the workpiece M by plastic deformation while the workpiece M is sandwiched between the pair of pinch rolls 22, 23 of a diameter of 200 mm and the ratio $\beta$ of the area of recesses 12 to the total surface area of the workpiece. In FIG. 24, tests involved workpieces M having thicknesses of 10 mm, 20 mm and 30 mm. As is clear from FIG. 24, the load is drastically increased when the ratio $\beta$ is increased above 0.7 (i.e. 70%). Accordingly, the recesses 12 can be formed with a relatively low load if the ratio $\beta$ of the area of the recesses 12 to the total surface area of the workpiece is no greater than 70%.

In accordance with this aspect of the present invention, the load required to effect rolling, particularly hot rolling, can be decreased. Also, it is possible to prevent a substantial increase in load required to form the recesses 12 by plastic deformation.

Although the present invention has been described and illustrated with respect to preferred embodiments and aspects thereof, it is to be understood that various changes may be made to the specifically described and illustrated features without departing from the scope of the invention. It particularly is to be understood that, as discussed above, the present invention contemplates the employment of the various aspects of the present invention both for cold rolling and for hot rolling operations.

We claim:

1. In a rolling method including rolling a metal workpiece in a rolling mill by work rolls to reduce said workpiece, the improvement comprising decreasing the rolling load of said work rolls for a given reduction ratio achieved thereby, said decreasing comprising:

providing a pair of pinch rolls upstream of said work rolls, with at least one of said pinch rolls having projections on the surface thereof;

prior to said rolling of said workpiece by said work rolls, forming a large number of recesses of regular configuration in at least one surface of said workpiece by passing said workpiece between said pinch rolls and forcing said projections into said at least one surface of said workpiece;

forcing a lubricating agent into said recesses in the region of contact between said workpiece and said work rolls; and conducting said rolling of said workpiece by said work rolls by initiating said rolling while said lubricating agent is retained in said recesses and continuing said rolling during which said recesses progressively are flattened, thus causing said lubricating agent to form a boundary film between the portion of said workpiece being rolled and said work rolls.

2. The improvement claimed in claim 1, wherein said rolling comprises a hot rolling operation.

3. The improvement claimed in claim 1, wherein said rolling comprises a cold rolling operation.

4. The improvement claimed in claim 1, wherein said workpiece comprises a flat plate or strip.

5. The improvement claimed in claim 1, comprising forming said recesses in opposite surfaces of said workpiece by projections on both of said pinch rolls.

6. The improvement claimed in claim 1, wherein said forcing comprises spraying said lubricating agent into said recesses.

7. The improvement claimed in claim 1, wherein said rolling comprises a hot rolling operation and said lubricating agent comprises water.

8. The improvement claimed in claim 1, comprising forming said recesses such that each said recess has an entrance having a dimension, in the direction of rolling of said workpiece, at least 3 mm and no greater than 30% of the length of the arcuate region of contact between said workpiece and the respective said work roll.

9. The improvement claimed in claim 8, comprising forming each said recess to have front and rear walls, in the direction of rolling of said workpiece, inclined at angles of from 30° to 65° relative to said surface of said workpiece.

10. The improvement claimed in claim 9, comprising forming said recesses in said surface of said workpiece such that the total area of said recesses is 20–70% of the total area of said surface.

11. The improvement claimed in claim 8, comprising forming said recesses in said surface of said workpiece such that the total area of said recesses is 20–70% of the total area of said surface.

12. The improvement claimed in claim 1, comprising forming each said recess to have front and rear walls, in the direction of rolling of said workpiece, inclined at angles of from 30° to 65° relative to said surface of said workpiece.

13. The improvement claimed in claim 12, comprising forming said recesses in said surface of said workpiece such that the total area of said recesses is 20–70% of the total area of said surface.

14. The improvement claimed in claim 1, comprising forming said recesses in said surface of said workpiece such that the total area of said recesses is 20–70% of the total area of said surface.

15. In a rolling machine including a rolling mill having work rolls for rolling a metal workpiece to reduce the workpiece, the improvement comprising means for decreasing the rolling load of said work rolls for a given reduction ratio achieved thereby, said decreasing means comprising:

means, positioned upstream of said work rolls, for forming a large number of recesses of regular configuration in at least one surface of a metal workpiece to be rolled, said means comprising a pair of pinch rolls positioned upstream of said work rolls, with at least one said pinch roll having projections on the surface thereof to be forced into the at least one surface of the workpiece to form the recesses therein;

means for forcing a lubricating agent into the recesses formed in the workpiece in the region of contact between the workpiece and said work rolls, such that the workpiece then is rolled by said work rolls of said rolling mill with the lubricating agent confined in the recesses; and said work rolls forming means operating such that as rolling of the workpiece is initiated thereby the lubricating agent is retained in the recesses in the workpiece, and as rolling of the workpiece thereby is continued the recesses progressively are flattened, thereby causing the lubricating agent to form a boundary film between the portion of the workpiece being rolled and said work rolls.

16. The improvement claimed in claim 15, wherein both said pinch rolls have projections to form recesses in opposite surfaces of the workpiece.

17. The improvement claimed in claim 15, wherein said forcing means comprises means for spraying the lubricating agent into the recesses.

18. The improvement claimed in claim 15, wherein said forcing means comprises means for spraying water as the lubricating agent.

19. The improvement claimed in claim 15, wherein said projections of said at least one pinch roll are shaped to form the recesses such that each recess has an entrance having a dimension, in the direction of rolling of the workpiece, at least 3 mm and no greater than 30% of the length of the arcuate region of contact between the workpiece and the respective said work roll.

20. The improvement claimed in claim 19, wherein said projections of said at least one pinch roll are shaped to form each recess to have front and rear walls, in the direction of rolling of the workpiece, inclined at angles of from 30° to 65° relative to the surface of the workpiece.

21. The improvement claimed in claim 20, wherein said projections of said at least one pinch roll are shaped to form the recesses in the surface of the workpiece such that the total area of the recesses is 20–70% of the total area of the surface.

22. The improvement claimed in claim 19, wherein said projections of said at least one pinch roll are shaped to form the recesses in the surface of the workpiece such that the total area of the recesses is 20–70% of the total area of the surface.

23. The improvement claimed in claim 15, wherein said projections of said at least one pinch roll are shaped to form each recess to have front and rear walls, in the direction of rolling of the workpiece, inclined at angles of from 30° to 65° relative to the surface of the workpiece.

24. The improvement claimed in claim 23, wherein said projections of said at least one pinch roll are shaped to form the recesses in the surface of the workpiece such that the total area of the recesses is 20–70% of the total area of the surface.

25. The improvement claimed in claim 15, wherein said projections of said at least one pinch roll are shaped to form the recesses in the surface of the workpiece such that the total area of the recesses is 20–70% of the total area of the surface.

* * * * *